US010734178B2

(12) United States Patent
Balbinot

(10) Patent No.: US 10,734,178 B2
(45) Date of Patent: Aug. 4, 2020

(54) ELECTROMAGNETIC CONTACTOR PROVIDED WITH MEANS FOR DETECTING THE OPEN OR CLOSED POSITION OF CONTROLLED SWITCHES

(71) Applicant: Zodiac Aero Electric, Montreuil (FR)

(72) Inventor: Jean-Pierre Balbinot, Le Kremlin-Bicetre (FR)

(73) Assignee: Zodiac Aero Electric, Montreuil (FR)

( * ) Notice: Subject to any disclaimer, the term of this patent is extended or adjusted under 35 U.S.C. 154(b) by 92 days.

(21) Appl. No.: 15/645,807

(22) Filed: Jul. 10, 2017

(65) Prior Publication Data

US 2018/0025871 A1 Jan. 25, 2018

(30) Foreign Application Priority Data

Jul. 20, 2016 (FR) ..... 16 56894

(51) Int. Cl.

| | |
|---|---|
| ***H01H 47/32*** | (2006.01) |
| ***H01H 47/00*** | (2006.01) |
| ***H01H 1/00*** | (2006.01) |
| ***H01H 9/16*** | (2006.01) |

(52) U.S. Cl.

CPC ..... *H01H 47/32* (2013.01); *H01H 1/0015* (2013.01); *H01H 9/167* (2013.01); *H01H 47/002* (2013.01)

(58) Field of Classification Search

CPC ..... H01H 45/00–14; H01H 47/00–36; H01H 50/00–86; H01H 51/00–34; H01H 1/0015; H01H 9/167; G01R 31/3274

See application file for complete search history.

(56) References Cited

U.S. PATENT DOCUMENTS

| | | | | |
|---|---|---|---|---|
| 5,153,522 | A * | 10/1992 | Sano | G01R 31/06 324/418 |
| 5,774,323 | A | 6/1998 | Innes et al. | |
| 2006/0098375 | A1* | 5/2006 | Lluch | H01H 47/325 361/139 |
| 2008/0036561 | A1 | 2/2008 | Hartinger et al. | |
| 2009/0316324 | A1* | 12/2009 | Scripca | H01H 47/043 361/160 |
| 2011/0228438 | A1* | 9/2011 | Kohri | H01H 1/0015 361/187 |
| 2013/0342950 | A1* | 12/2013 | Westrick, Jr. | H01H 47/22 361/170 |

(Continued)

FOREIGN PATENT DOCUMENTS

FR 2835061 A1 7/2003

OTHER PUBLICATIONS

French Search Report and Written Opinion, dated Dec. 6, 2016, issued in priority French Application No. 1656894, 15 Pages.

*Primary Examiner* — Thienvu V Tran
*Assistant Examiner* — Christopher J Clark
(74) *Attorney, Agent, or Firm* — Christensen O'Connor Johnson Kindness PLLC

(57) ABSTRACT

This electromagnetic contactor comprises a set of controlled switches (C1, C2, C3), at least one electromagnetic field generator (L; L1, L2), for example a coil, associated with an adjustable core (P) controlling the state of the controlled switches and a unit (UC) controlling the power supply of the electromagnetic field generator. It comprises means for detecting the position of the adjustable core to detect the state of the controlled switches.

8 Claims, 6 Drawing Sheets

(56) References Cited

U.S. PATENT DOCUMENTS

| | | | | |
|---|---|---|---|---|
| 2015/0200068 | A1* | 7/2015 | Kinoshita | H01H 47/04 361/170 |
| 2016/0042899 | A1* | 2/2016 | Zhou | H01H 47/22 361/206 |
| 2016/0069466 | A1 | 3/2016 | Etzler | |
| 2016/0131712 | A1 | 5/2016 | Bock et al. | |
| 2016/0133410 | A1* | 5/2016 | Bock | H01H 47/22 361/160 |
| 2016/0358732 | A1* | 12/2016 | Nishio | H01H 47/002 |
| 2018/0174786 | A1* | 6/2018 | Matsuo | H01F 7/1811 |
| 2018/0218862 | A1* | 8/2018 | Matsuo | H01H 47/223 |

* cited by examiner

ELECTROMAGNETIC CONTACTOR PROVIDED WITH MEANS FOR DETECTING THE OPEN OR CLOSED POSITION OF CONTROLLED SWITCHES

BACKGROUND

The present invention relates to an electromagnetic contactor and relates more particularly to the control of the open or closed state of such a contactor.

An electromagnetic contactor, or power relay, is an electronic component which ensures the switching of a power supply.

The voltage levels involved can be for example of the order of 115 volts alternating current (VAC), of 230 volts VAC, or even for example in the order of 540 volts direct current.

The current levels supported by the contactor can be of the order of a few tens to a few hundreds of amperes.

The electromagnetic contactors are generally driven remotely from a control signal and comprise one or more electromagnetic field generators equipped with an adjustable core whose displacement provides the switching of controlled switches.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

Reference can be made to FIGS. 1 and 2 which illustrate two embodiments of an electromagnetic contactor according to the prior art.

In the embodiment of FIG. 1, the electromagnetic contactor comprises two electromagnetic field generators, formed respectively by two coils L1 and L2 connected in parallel between a direct current power source, here 28 volts DC, and the ground. The two coils are connected to the ground via two controlled switches made up of two transistors T1 and T2 whose open and closed states are controlled by a control unit UC in response to a control signal C received as input.

The two coils L1 and L2 each ensure the displacement of a common adjustable core (also referred to as a solenoid plunger) linked mechanically to switches C1, C2 and C3 connected to three phases A, B and C of a three-phase power line, here 115 volts VAC. One of the coils is intended to ensure the switching of the switches C1, C2 and C3, the other coil for its part ensuring the maintaining of the state of the switches C1, C2 and C3.

In the embodiment of FIG. 2, the electromagnetic contactor comprises a single coil L, associated with an adjustable core also referred to as a solenoid plunger linked to the switches C1, C2 and C3 of the three phases A, B and C of the power line.

The coil L is connected between a direct voltage source, here 28 volts, and the ground via a controlled switch made up of a transistor T and whose open or closed state is driven by a central unit UC receiving a control signal C.

In this embodiment, the coil ensures the switching and the maintaining of the state of the switches according to the current which passes through it.

This current, driven by pulse width modulation, is different in the switching from the maintaining phase.

In the two embodiments, the electromagnetic contactor delivers an item of information relating to the open or closed state of the switches C1, C2 and C3.

In this respect, the contactor comprises two auxiliary contacts AUX_NO and AUX_NF respectively delivering switch opening and closure information items. These auxiliary contacts consist of the output of two conductive lines powered by a DC signal AUX_COM. Said conductive lines are each equipped with an auxiliary switch C'1 and C'2 whose open and closed state is controlled by the adjustable core linked to the switches C1, C2 and C3 such that the auxiliary contacts AUX_NO and AUX_NF copy the level of the input voltage AUX_COM when the switches C1, C2 and C3 are closed.

The auxiliary contacts thus allow the electromagnetic contactor to supply a switch status information item and make it possible to determine whether these switches are open or closed in accordance with the control C.

The auxiliary contacts thus make it possible to detect a malfunction of the central unit or a blocking of the contactors in open or closed position.

The detection of the state of the electromagnetic contactor however implements a relatively complex mechanical device.

So, the aim of the invention is to mitigate this drawback and to allow the detection of the open or closed state of an electromagnetic contactor without implementing such mechanical devices.

Thus, the subject of the invention is an electromagnetic contactor, comprising a set of controlled switches, at least one electromagnetic field generator, for example a coil, associated with an adjustable core controlling the state of the controlled switches and a unit controlling the power supply of the generator.

This contactor comprises means for detecting the position of the adjustable core to detect the state of the controlled switches.

In one embodiment, the means for detecting the position of the adjustable core comprise means for computing the value of the impedance of said generator, notably the inductance.

Advantageously, the value of said impedance is computed from the value of the power supply voltage of said generator for a predetermined duration and from a measured value of the current circulating in the generator.

In one embodiment, the electromagnetic contactor comprises storage means in which are stored impedance values, notably values of the resistance of the generator, as a function of the temperature of the generator, said impedance value of the generator being extracted from the storage means.

According to another feature of the electromagnetic contactor according to the invention, the computation means comprise means for comparing the value of the inductance of the generator with inductance values corresponding respectively to an open and closed state of the contactor.

In one embodiment, the contactor comprises a single electromagnetic field generator.

In another embodiment, the electromagnetic contactor comprises two electromagnetic field generators acting on a common adjustable core and each driven by a switch, a first generator ensuring the closure of the contactor, and a second generator ensuring the maintained closure of the contactor.

Also a subject of the invention, according to a second aspect, is a method for determining the open or closed state of the electromagnetic contactor as defined above, in which:

the contactor is powered for a predetermined duration with a power supply voltage;

the current circulating in the generator is measured;

the value of the impedance of the generator is computed; and the computed impedance value is compared with a set of at least one threshold value for protecting the open or closed state of the contactor.

In one implementation, the impedance value is computed from a measurement of the current circulating in the generator.

According to another feature of the method according to the invention, said contactor having a single electromagnetic field generator, a detection current is superimposed on a maintaining current, the current circulating in the generator is measured, the value of the maintaining current is subtracted from the measured current value and the value of the impedance is computed.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

Other aims, features and advantages of the invention will emerge on reading the following description, given purely as a nonlimiting example and with reference to the attached drawings in which.

DETAILED DESCRIPTION

Figure 1:
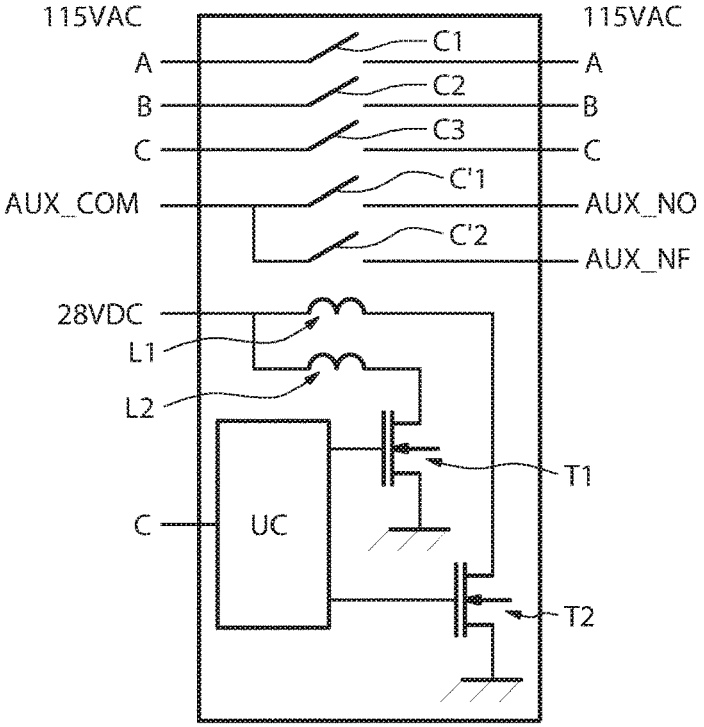
FIG.1 (PRIOR ART)
FIGS. 1 and 2, already mentioned, illustrate the structure of two embodiments of an electromagnetic contactor according to the prior art.
Figure 2:
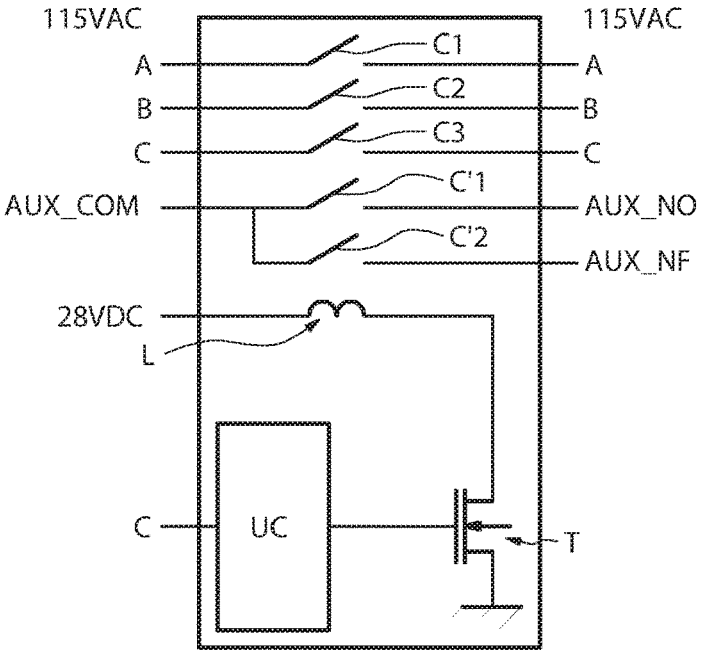
FIG.2 (PRIOR ART)
Figure 3:
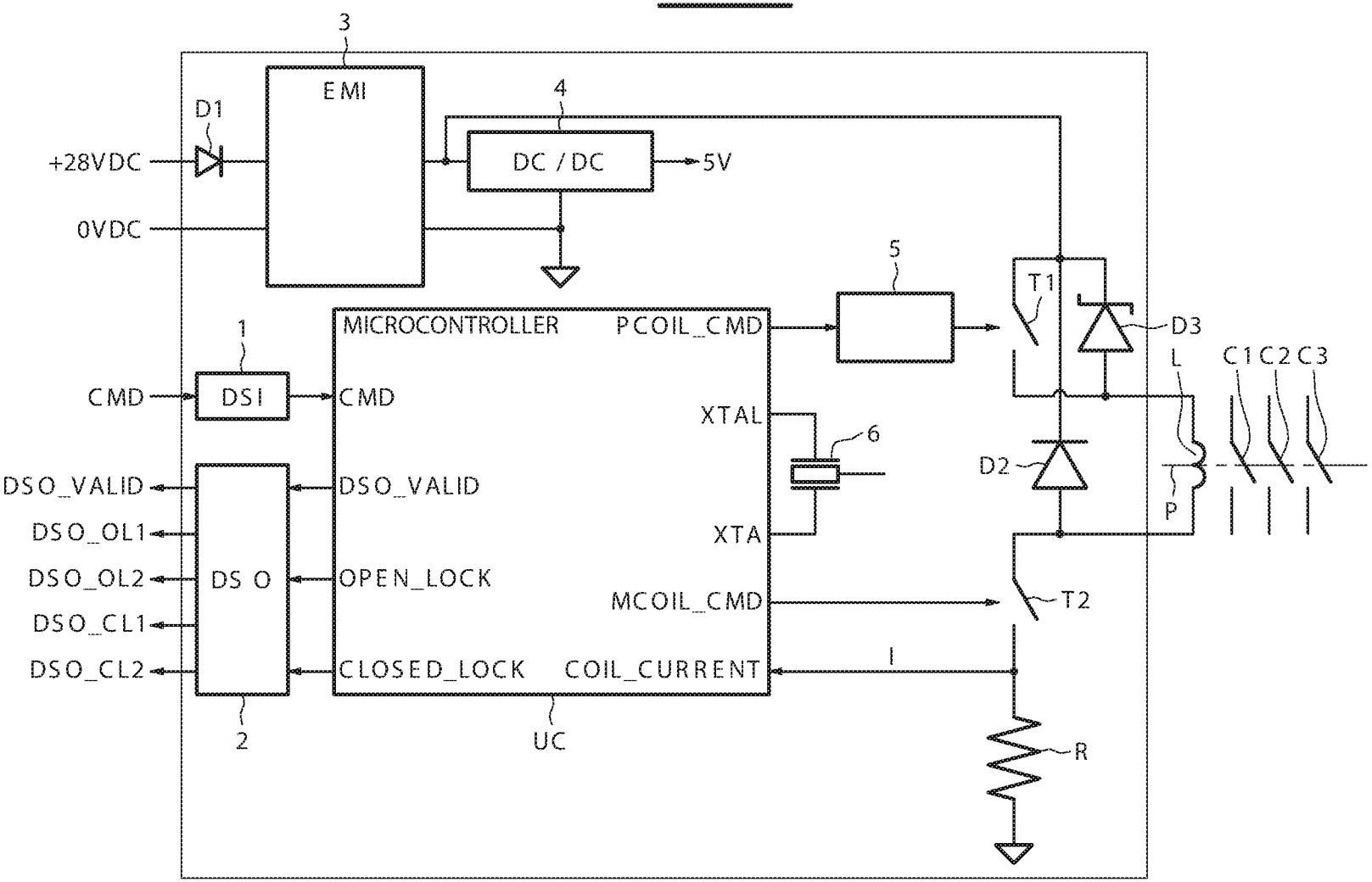
FIGS. 3 and 4 illustrate two embodiments of an electromagnetic contactor according to the invention.

Reference is first of all made to FIG. 3 which illustrates a first exemplary embodiment of an electromagnetic contactor according to the invention.

This embodiment corresponds to an arrangement of the contactor having a single electromagnetic field generator associated with an adjustable core (also referred to as a solenoid plunger) P linked mechanically to the three switches C1, C2 and C3 of a power supply line.

As can be seen, the generator here consists of a coil L associated with the adjustable core (also referred to as a solenoid plunger) P.

The contactor comprises a central unit UC consisting of a microcontroller or of another programmable logic element, an input circuit 1 DSI receiving a control signal CMD and an output circuit 2 DSO comprising open collector stages serving to emulate the auxiliary contacts. The output circuit delivers two outputs DSO_OL1 and DSO_OL2, corresponding to the normally open auxiliary contacts, and two outputs DSO_CL1 and DSO_CL2, corresponding to the normally closed auxiliary contacts of the electromagnetic switches according to the prior art, which supply an indication relating to the opening and to the closing of the contactor as well as a signal DSO_VALID representative of the validity of the output signals DSO_OL1, . . . , DSO_CL2.

The contactor also comprises a power supply circuit comprising two power supply inputs 28 VDC and 0 VDC of contactor at 28 volts direct current. This circuit comprises an electromagnetic interference filtering stage 3 produced from two inductances and two capacitors and supplied with direct voltage via a diode D1 and a DC-DC converter 4 here delivering a DC voltage at approximately 5 volts for supplying various constituent elements of the contactor, and in particular of the microcontroller UC of the contactor.

The coil L is supplied from the output of the filtering stage 3 under the control of two controlled switches T1 and T2, made up of the transistors driven by the microcontroller.

The first transistor T1 is driven by a control signal PCOIL_CMD, via a voltage converter 5, whereas the second switch T2 is driven by an output MCOIL_CMD supplied by the microcontroller. The two control signals PCOIL_CMD and MCOIL_CMD are generated in response to the reception of a control signal CMD by the input circuit 1.

As can be seen, the second switch T2 is connected to the ground via a resistor R and the midpoint between the switch T2 and the resistor R is connected to an input MCOIL_CURRENT of the microcontroller to supply a measurement of the current I circulating through the coil L.

The circuit of the electromagnetic contactor is completed by an oscillator 6 ensuring the clocking of the microcontroller.

Furthermore, a freewheeling diode D2 is connected in parallel to the coil L and, in particular, between the midpoint between the second switch T2 and the inductance L, on the one hand, and the mid-point between the first switch T1 and the output of the filtering stage 3, in order to avoid overvoltages that can destroy the transistors on opening. Finally, a Zener diode D3 is connected in parallel to the first switch T1 to improve the discharging upon the opening of the switch, by forming the discharge at a higher voltage. In this embodiment, the control of the closing of the switches C1, C2 and C3 is performed under the control of the output PCOIL_CMD which drives the first switch T1.

The maintaining of the controlled switches C1, C2 and C3 in the closed state is formed controlling the second switch T2 by pulsed width modulation from a measurement of the current I circulating in the coil L.

Figure 4:
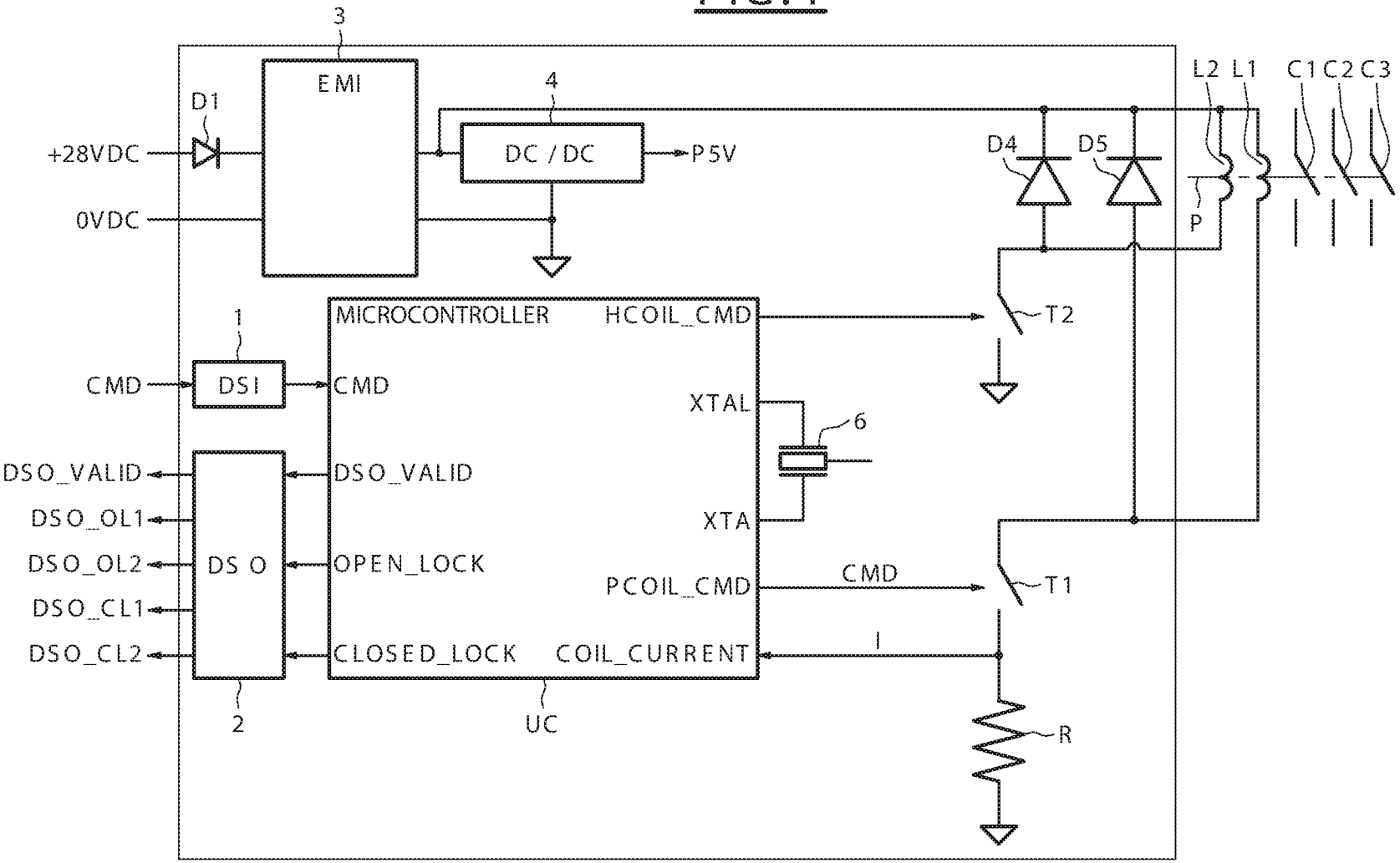

In the embodiment illustrated in FIG. 4, which corresponds to an arrangement with two coils L1 and L2 which provoke the displacement of a common adjustable core P linked mechanically to the controlled switches C1, C2 and C3, it can be seen that, as in the embodiment of FIG. 3, the contactor comprises a central unit UC associated with its input circuit 1 and with its output circuit 2, a power supply circuit comprising an electromagnetic interference filtering stage 3, a direct current-direct current converter 4 ensuring the powering of the constituent elements of the contactor, and an oscillator 6 for clocking the microcontroller.

These various elements are identical to those described previously with reference to FIG. 3 and will not therefore be detailed.

Also to be recognized, the two switches T1 and T2 respectively ensure the control of the closing of the switches C1, C2 and C3 and the maintaining of these switches in the controlled state.

The first switch T1 is controlled by a signal PCOIL_CMD delivered by the microcontroller whereas the second switch T2 is driven by an output HCOIL_CMD of the microcontroller.

As in the embodiment described previously, a freewheeling diode D4 and D5 is connected in parallel to each coil to avoid the appearance of overvoltage upon the opening of the switches. A Zener diode, not represented, can also be provided to facilitate the discharging of the inductances upon the opening of the switches.

In this embodiment, when the power line needs to be closed, in response to a control signal CMD received as input of the input circuit 1, the first and second switches T1 and T2 are closed to provoke the simultaneous powering of the coils L1 and L2 and the consequent displacement of the adjustable core.

The closed state of the switches C1, C2 and C3 is maintained by maintaining the second switch T2 closed and a maintained power supply to the second coil L2. In this embodiment, the switch T1 is open and the power supply of the coil L1 is interrupted.

As in the embodiment described with reference to FIG. 3, a measurement of current I passing through the control coil L1 is delivered at the input COIL_CURRENT of the microcontroller.

As indicated previously, in the embodiment of FIGS. 3 and 4, the microcontroller supplies an indication relating to the locking in the open state and to the locking in the closed state of the switches C1, C2 and C3. These information items are delivered by "OPEN_LOCK" and "CLOSED_LOCK" outputs to the output circuit DSO 2. These information items are delivered redundantly by the respective outputs DSO_OL1 and DSO_OL2, on the one hand, and DSO_CL1 and DSO_CL2, on the other hand, of the output circuit. Furthermore, the microcontroller and the output circuit 2 supply an indication DSO_VALID, reflecting the validity of the information item supplied on the OPEN_LOCK and CLOSED_LOCK outputs.

The microcontroller in fact incorporates means, notably software, for detecting the position of the adjustable core to detect the state of the controlled switches.

In one embodiment, these detection means comprise means for computing the value of the impedance of the electromagnetic field generator or generators. In the embodiment of FIGS. 3 and 4, these are means for computing the value of the inductance of the coils L and L1.

In effect, the inductance of the control coil is different depending on the position of the core and, consequently, of the controlled switches. This value can vary by 30% to 40% depending on the position of the core which actuates the switches.

Thus, the microcontroller is provided with comparison means which ensure the comparison of the value of the inductance of the coil with threshold values for detecting the opening and closing of the switches, in order to detect the open or closed state of the switches.

The value of the inductance of the coil L of the embodiment of FIG. 3 or that of coil L1 of the embodiment of FIG. 4 is computed from the following relationship:

$$L = -\frac{t \times R}{\ln\left(1 - \frac{R \times I}{V}\right)} \quad (1)$$

in which:

V designates the power supply voltage of the coil;

t designates the coil power supply duration;

I designates the current passing through the coil at the end of the duration t; and R designates the resistance of the coil.

Thus, by supplying the coil with a voltage V for a time t, and by measuring the current I passing through the coil at the end of the time t, the value of the coil can be computed and compared with threshold values to detect the open or closed state of the switches.

However, the value of the resistance of the coil varies as the function of the temperature. Thus, the microcontroller incorporates, preferably, stored in memory, a table of resistance values, previously measured as a function of the temperature. The value of the resistance, used for the computation of the value of the inductance, is then extracted from the table, based on a measurement of temperature of the coil.

Figure 5:
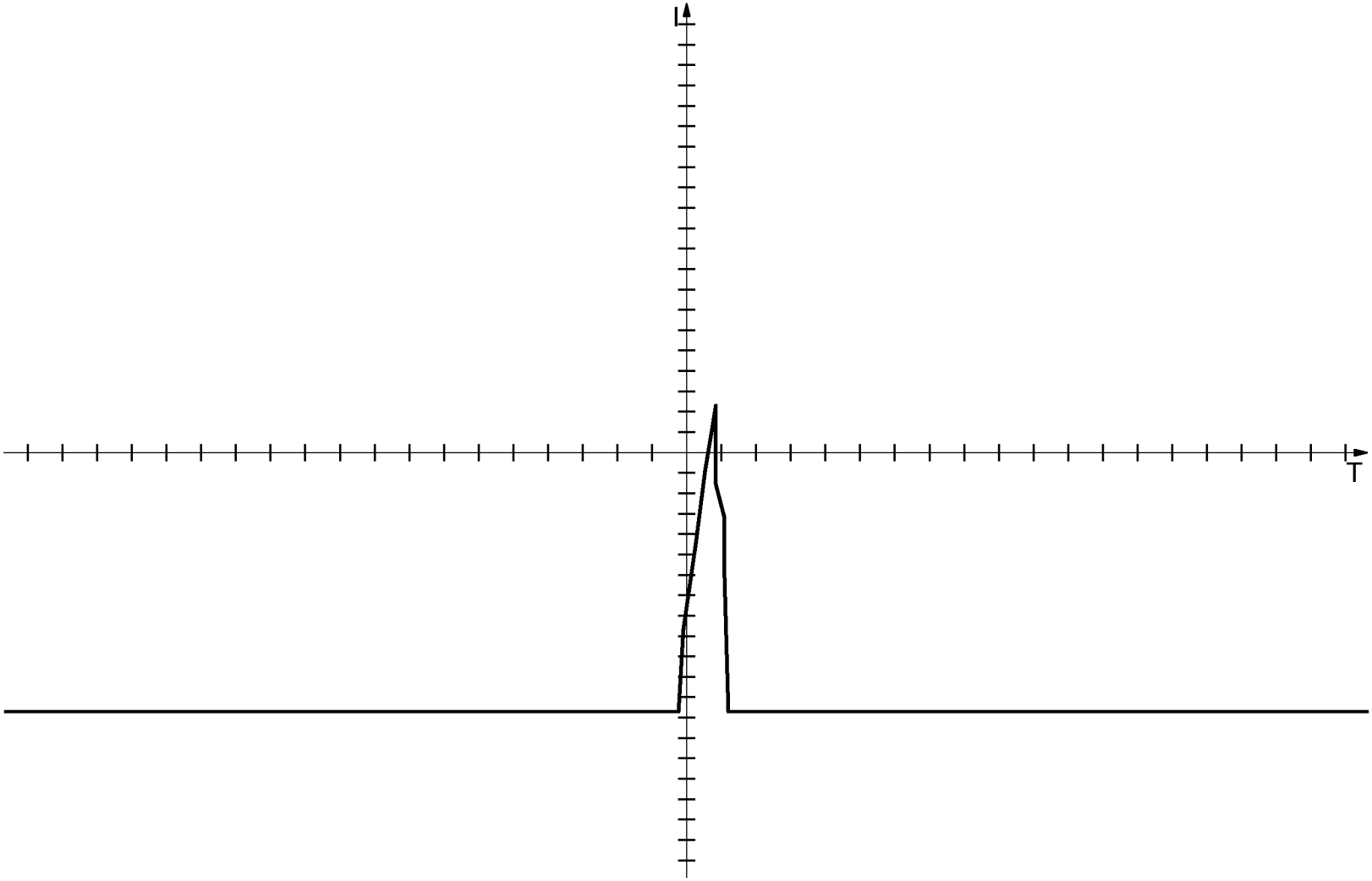
FIGS. 5 and 6 illustrate the trend as a function of time of the current of an inductance, when the contactor is open and closed, respectively.
Figure 6:
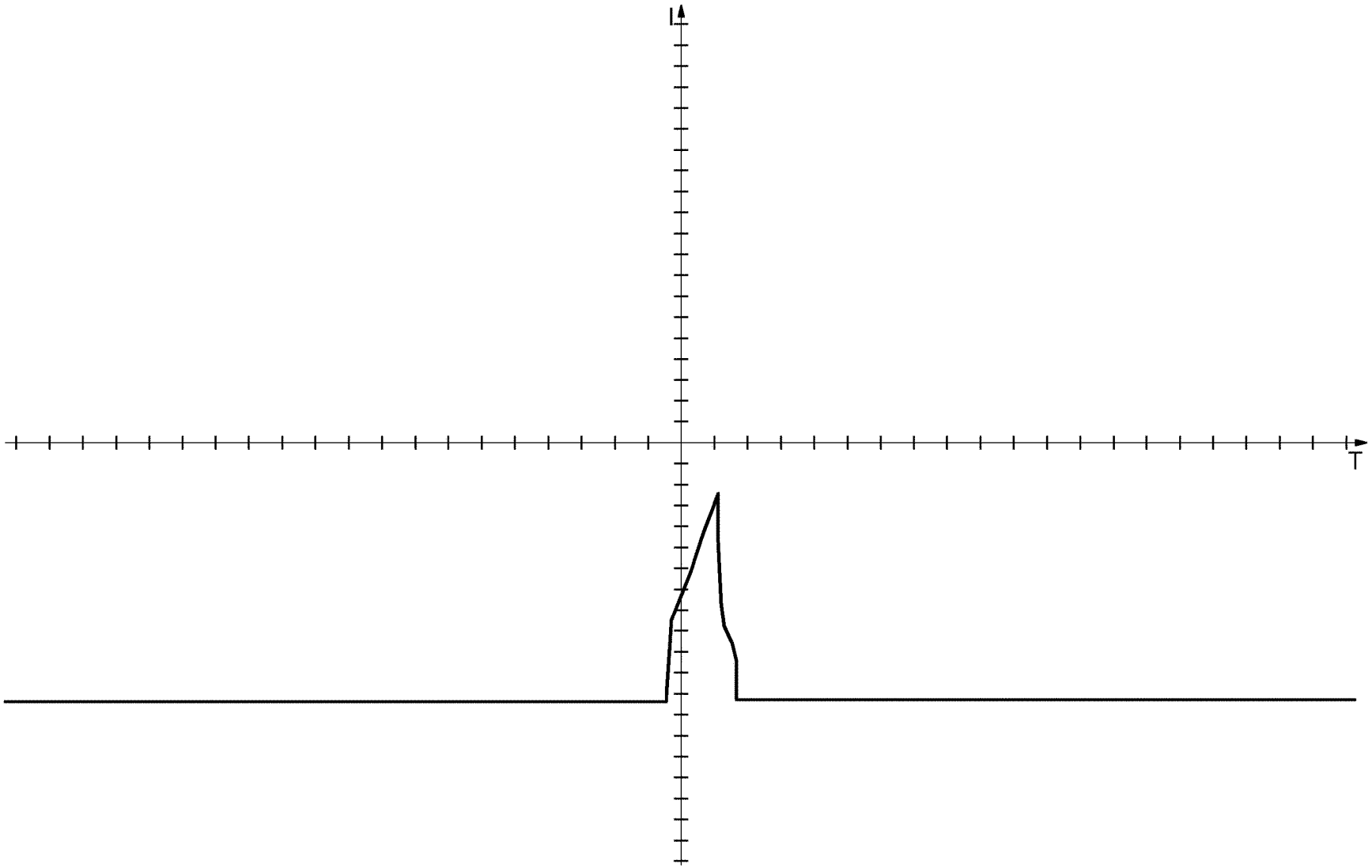

Referring to FIGS. 5 and 6, which illustrate the trend of the current circulating in a coil as a function of the time, respectively for a contactor in open position and in closed position, it can be seen that the closing of the switch is accompanied by a modification of the slope of the current of the coil. This slope can be evaluated electronically and corresponds to an increase in the inductance value of at least 50%.

Thus, the microcontroller supplies a first information item, "contactor correctly opened" by provoking the powering of the coil for a relatively short duration, that is to say less than the duration needed to provoke the effective closing of the contactor, for example for a duration of 250 microseconds and by evaluating the slope of the current as a function of time, which reflects the value of the inductance. The information item corresponding to the correct opening of the contactor is supplied on the "OPEN_LOCK" output.

With respect to the detection of the closed state, in the embodiment of FIG. 3 which corresponds to an embodiment with a single inductance, in which the locking of the switches is maintained by applying a pulse width modulated current to the switch T2, the value of the inductance is measured periodically by applying an additional current in the coil.

The value of the maintaining current is then subtracted from the value of the measured current, which corresponds to the parameter I of the relationship (1), and the value of the inductance is computed from said relationship (1).

In an embodiment of FIG. 4, in which the contactor comprises two coils L1 and L2, respectively control and maintaining, the value of the inductance of the coil L1 which is used in the switching, which is no longer powered during the maintaining by momentarily closing the switch T1, is computed by measuring the current I and the voltage V at the end of a predetermined duration. For example, the duration t can be equal to approximately 250 microseconds. It is thus possible to supply an information item of "contactor correctly closed" type on the "CLOSED_LOCK" output of the microcontroller.

As is understood, the invention which has just been described makes it possible to determine the position of the adjustable core of a coil controlling the open or closed state of switches from the modification of the inductance. Such a modification is a function of the position of the core or, in other words, that the value of the air gap of the core, and of the current passing through said core.

Figure 7:
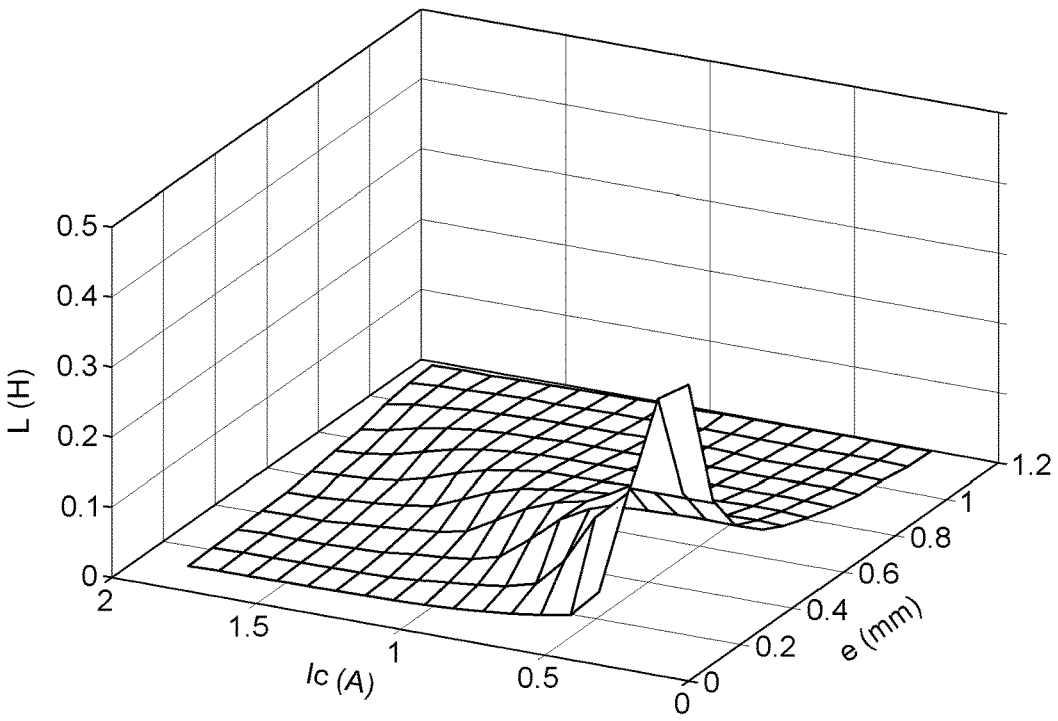
FIG. 7 is a three-dimensional curve showing the trend of the value of an inductance of a contactor as a function of the position of the adjustable core and of the current passing through the inductance.
Figure 8:
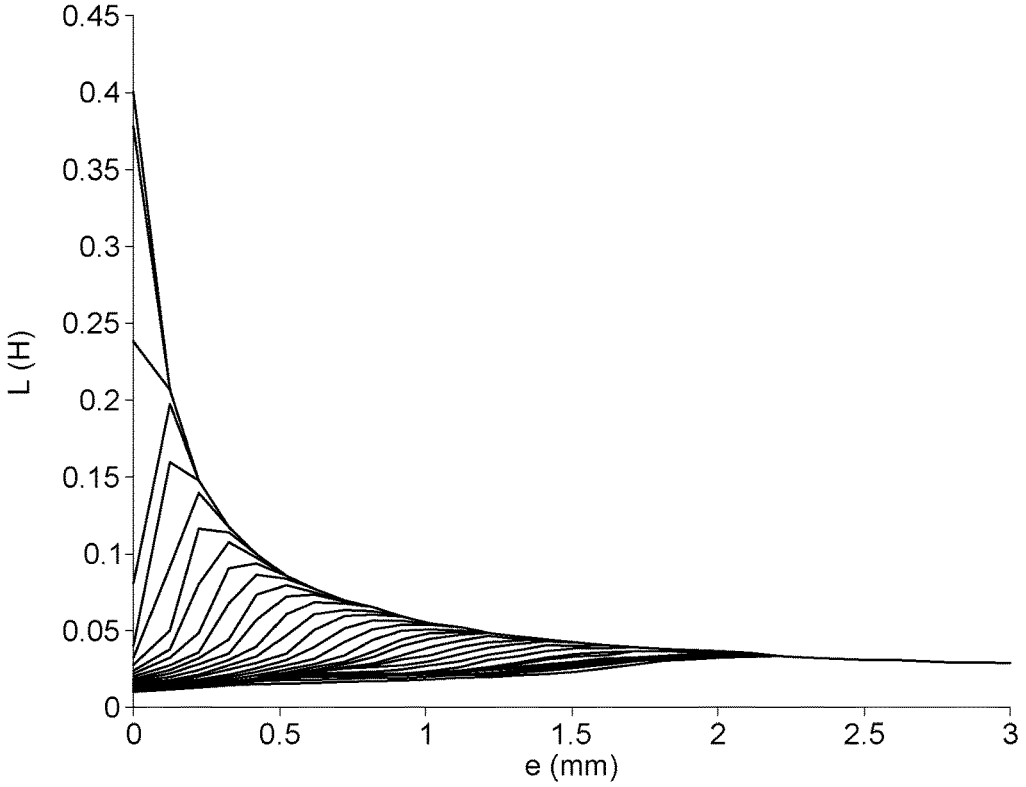
FIG. 8 shows the trend, as a function of the air gap of the adjustable core, of the value of an inductance.

It can be seen in fact in FIG. 7 that the value of the inductance increases as a function of the value of the air gap e. FIG. 8, which illustrates the variation of the inductance as a function of the air gap, confirms that, when there is no current in the coil, the value of the inductance increases very significantly when the air gap of the core decreases. By contrast, when there is a current tending to saturate the coil, the value of said coil decreases very substantially when the air gap of the core decreases.

It will finally be noted that the invention is not limited to the embodiments described.

In effect, in the exemplary embodiments described with reference to FIGS. 3 and 4, the detection of the open or closed state of the switches is performed from a measurement of the current circulating in a coil.

In other embodiments, the detection of the position of the adjustable core is performed by using a capacitor having two armatures, one secured to the adjustable core and the other fixed, by computing the value of the capacitor and by comparing the computed value with threshold values for detecting the opening and closing of the switches.

According to another embodiment, a secondary inductance is used, magnetically coupled to the core and whose value is computed as a function of the displacement of the core.

It is also possible to use, in a variant, a Hall effect sensor, which directly supplies a measurement of the position of the adjustable core by measuring the magnetic field differences induced by the adjustable core or even an optical sensor detecting a radius masked or not masked by a part secured to the adjustable core.

While illustrative embodiments have been illustrated and described, it will be appreciated that various changes can be made therein without departing from the spirit and scope of the invention.

The embodiments of the invention in which an exclusive property or privilege is claimed are defined as follows:

1. An electromagnetic contactor, comprising a set of controlled switches, at least one electromagnetic field generator associated with an adjustable core controlling the state of the controlled switches, a unit controlling a power supply of the electromagnetic field generator and means for detecting the position of the adjustable core to detect the state of the controlled switches and to determine inductance of the electromagnetic field generator and compare the determined inductance with a threshold value to detect an open or closed state of the contactor, wherein the inductance is determined based on the following formula:

$$L = -\frac{t \times R}{\ln\left(1 - \frac{R \times I}{V}\right)}$$

wherein:

V designates a power supply voltage supplied to the electromagnetic field generator, t designates a duration the power supply voltage is supplied to the electromagnetic field generator, I designates a current passing through the electromagnetic field generator at the end of the duration t, and R designates a resistance of the electromagnetic field generator, wherein the means for detecting the position of the adjustable core comprises storage means in which are stored values of the resistance of the electromagnetic field generator, as a function of the temperature of the electromagnetic field generator, said values of the resistance of the electromagnetic field generator being extracted from the storage means.

2. The electromagnetic contactor of claim 1, in which the means for detecting a position of the adjustable core comprises means for comparing the value of the inductance of the electromagnetic field generator with inductance values as the threshold values corresponding respectively to an open and closed state of the contactor.

3. The electromagnetic contactor of claim 1, in which the contactor comprises a single electromagnetic field generator.

4. The electromagnetic contactor of claim 1, comprising two electromagnetic field generators acting on a common adjustable core and each driven by a switch, a first electromagnetic field generator ensuring the closure of the contactor, and a second electromagnetic field generator ensuring the maintained closure of the contactor.

5. A method for determining the open or closed state of an electromagnetic contactor of claim 1, in which:

the contactor is powered for a predetermined duration with a power supply voltage;

the current circulating in the generator is measured;

the value of the inductance of the generator is computed; and the computed inductance value is compared with a set of at least one threshold value for detecting the open or closed state of the contactor.

6. The method of claim 5, wherein the inductance value is computed from a measurement of a current circulating in the generator.

7. The method of claim 5, wherein said contactor has a single electromagnetic field generator, a detection current is superimposed on a maintaining current, the current circulating in the generator is measured, the value of the maintaining current is subtracted from the measured current value and the value of the inductance is computed.

8. The electromagnetic contactor of claim 1, wherein the at least one electromagnetic field generator comprises a coil.

* * * * *